US008312994B2

(12) United States Patent
Schneider et al.

(10) Patent No.: US 8,312,994 B2
(45) Date of Patent: Nov. 20, 2012

(54) CYLINDRICAL DEDUSTING APPARATUS FOR PARTICULATE MATERIAL

(75) Inventors: Heinz Schneider, Lancaster, PA (US); Paul Wagner, Lancaster, PA (US)

(73) Assignee: Pelletron Corporation, Lancaster, PA (US)

( * ) Notice: Subject to any disclaimer, the term of this patent is extended or adjusted under 35 U.S.C. 154(b) by 241 days.

(21) Appl. No.: 12/718,494

(22) Filed: Mar. 5, 2010

(65) Prior Publication Data

US 2010/0236583 A1 Sep. 23, 2010

Related U.S. Application Data

(60) Provisional application No. 61/161,402, filed on Mar. 18, 2009.

(51) Int. Cl.
*B07B 7/00* (2006.01)

(52) U.S. Cl. ..... 209/139.1; 209/138; 209/150

(58) Field of Classification Search ..... 209/136–139.1, 209/142, 146, 149, 150, 477, 720, 721
See application file for complete search history.

(56) References Cited

U.S. PATENT DOCUMENTS

| | | | | |
|---|---|---|---|---|
| 1,499,725 | A * | 7/1924 | Fraser | 209/137 |
| 1,522,151 | A * | 1/1925 | Stebbins | 209/150 |
| 2,729,330 | A * | 1/1956 | Newirth | 209/138 |
| 2,739,708 | A * | 3/1956 | Denovan et al. | 209/138 |
| 2,795,329 | A * | 6/1957 | Schaub | 209/139.1 |
| 5,035,331 | A | 7/1991 | Paulson | 209/39 |
| 5,294,002 | A * | 3/1994 | Moses | 209/135 |
| 5,695,069 | A * | 12/1997 | Mortrud | 209/23 |
| 6,712,216 | B2 * | 3/2004 | Van Oirschot | 209/138 |
| 7,380,670 | B2 | 6/2008 | Paulson | 209/3 |
| 8,016,116 | B2 * | 9/2011 | Schneider | 209/139.1 |
| D654,105 | S * | 2/2012 | Schneider | D15/147 |

* cited by examiner

*Primary Examiner* — Joseph C Rodriguez

(74) *Attorney, Agent, or Firm* — Miller Law Group, PLLC

(57) ABSTRACT

A cylindrical dedusting apparatus has an upper material infeed opening to introduce material into a frusto-conical infeed hopper centered over the tip of a conical wash deck supported over an air infeed conduit. Air is blown through slots and openings in the surface of the wash deck to separate dust and debris from the particulate material. The dust-laden air is discharged by passing between the infeed hopper and a cylindrical sleeve to enter into a circular collector for discharge from the apparatus. Flow rate of material over the wash deck is adjusted by vertically moving the infeed hopper within the sleeve relative to the wash deck, the tip serving as a stopper to define the dimension of the gap through which material flows onto the wash deck. Cleaned material passes through a lower discharge opening while dirty air is removed through a radially oriented discharge conduit from the circular collector.

26 Claims, 10 Drawing Sheets

Fig. 10
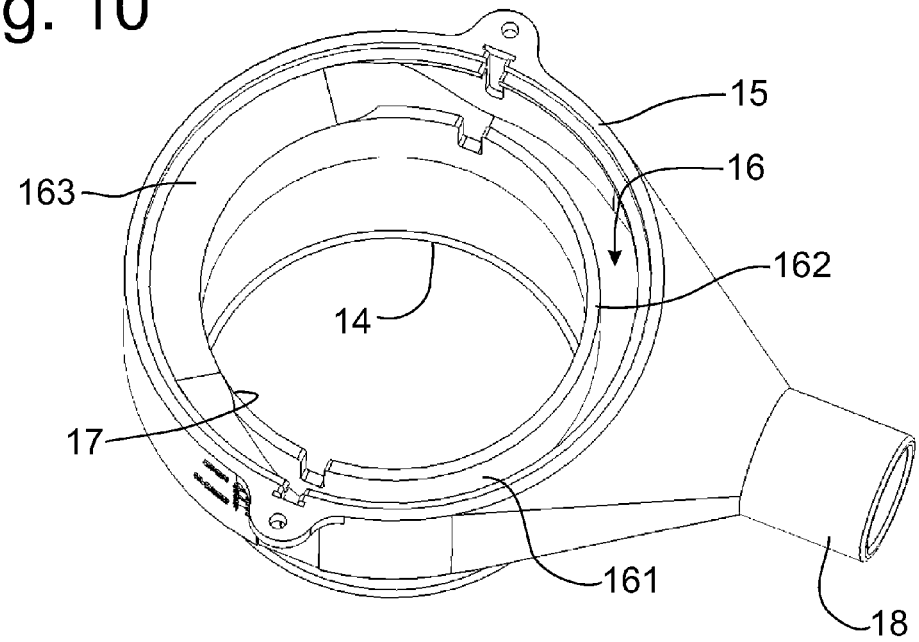
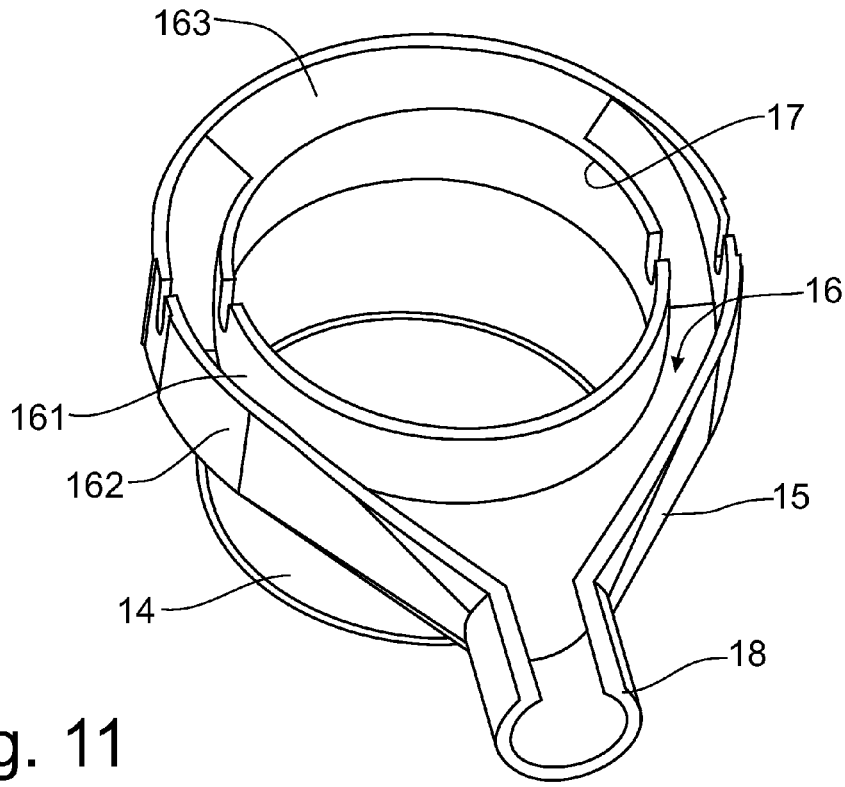
Fig. 11

Fig. 12
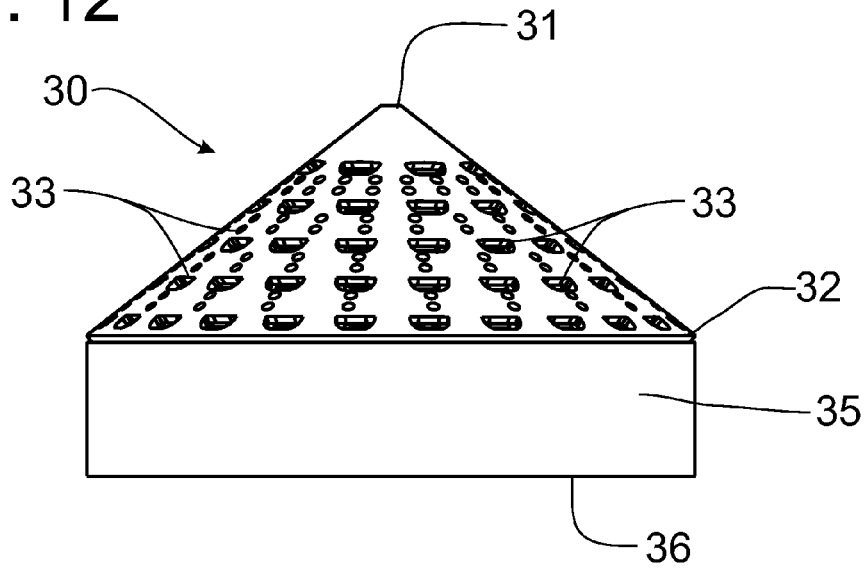
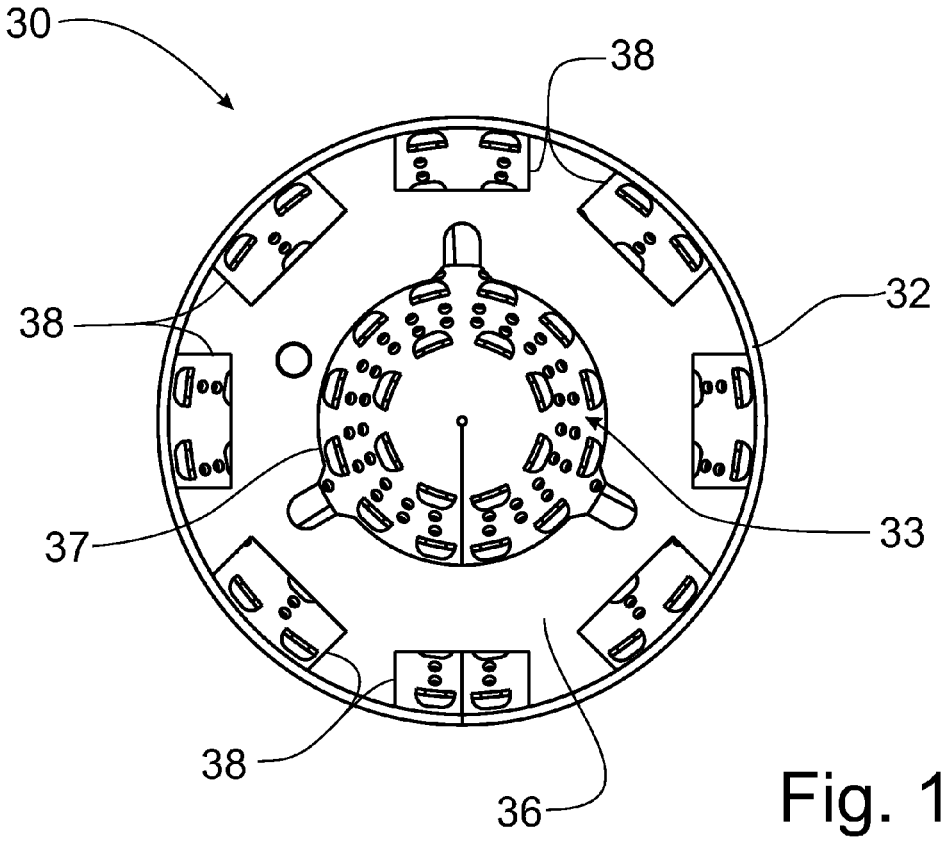
Fig. 13

Fig. 14
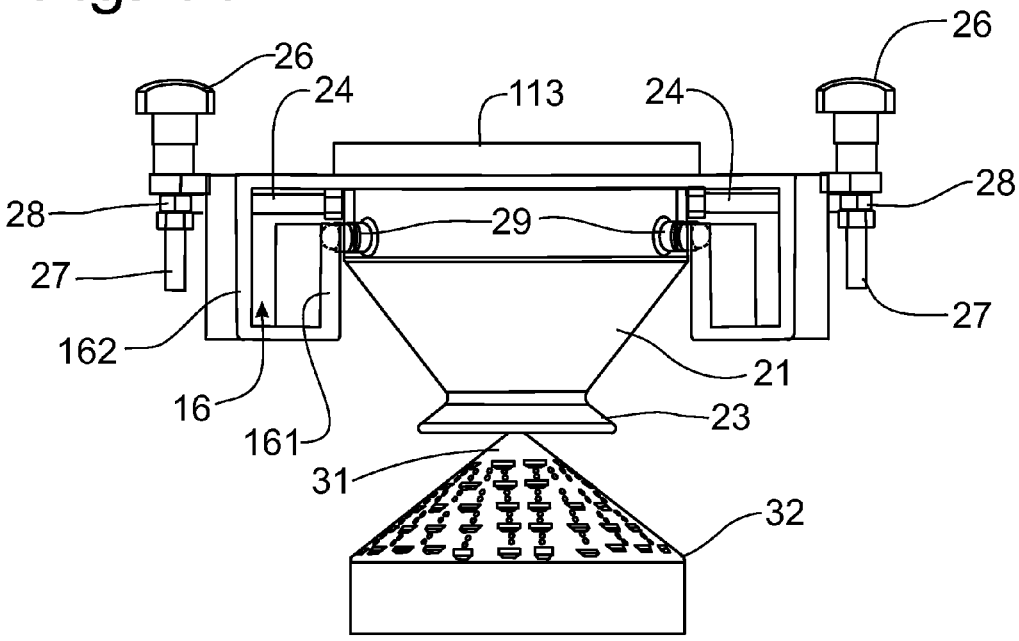
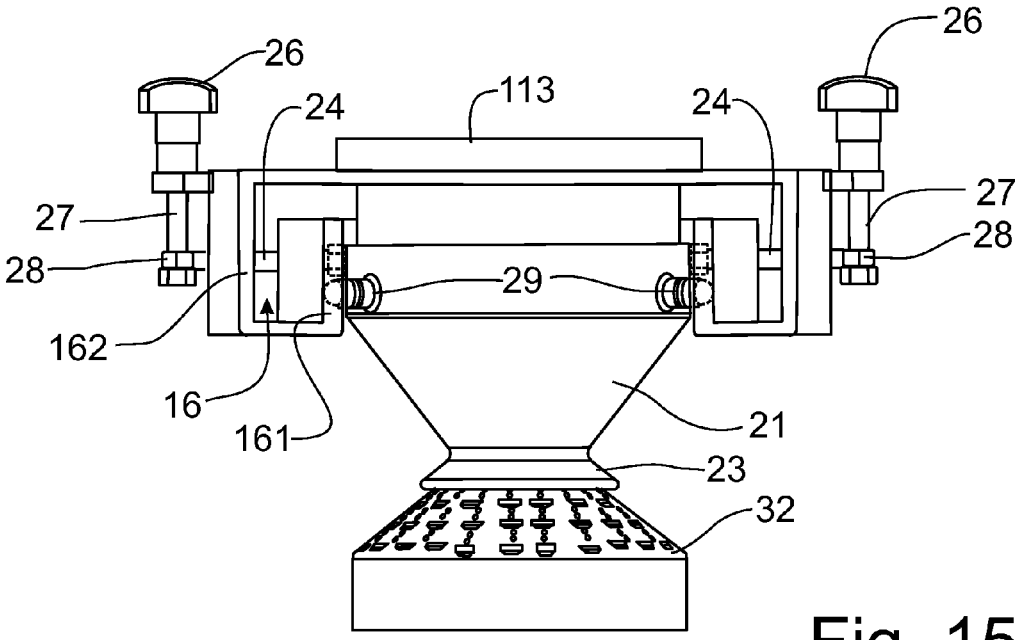
Fig. 15

CYLINDRICAL DEDUSTING APPARATUS FOR PARTICULATE MATERIAL

CROSS-REFERENCE TO RELATED APPLICATIONS

This application claims domestic priority on U.S. Provisional Patent Application Ser. No. 61/161,402, filed on Mar. 18, 2009, and entitled "Cylindrical Dedusting Apparatus for Particulate Material", the content of which is incorporated herein by reference.

FIELD OF THE INVENTION

The invention disclosed in this application is directed generally to the cleaning and handling of particulate materials, such as plastic pellets, regrind, tablets, grains, minerals, and the like, and particularly to a dedusting apparatus that is configured in a cylindrical configuration to provide an increased operative capacity due to a 360 degree cleaning operation.

BACKGROUND OF THE INVENTION

It is well known, particularly in the field of transporting and using particulate materials, commonly coarse powders, granules, pellets, and the like that it is important to keep product particles as free as possible of contaminants. Particulates are usually transported within a facility where they are to be mixed, packaged or used in a pressurized tubular system that in reality produces a stream of material that behaves somewhat like a fluid. As these materials move through the pipes, considerable friction is generated not only among the particles themselves, but also between the tube walls and the particles in the stream. In turn, this friction results in the development of particle dust, broken particles, fluff, and streamers (ribbon-like elements that can "grow" into quite long and tangled wads that will impede the flow of materials or even totally block the flow). The characteristics of such a transport system are quite well known, as is the importance and value of keeping product particles as free as possible of contaminants.

The term "contaminant" as used herein includes a broad range of foreign material, as well as the broken particles, dust, fluff and streamers mentioned in the preceding paragraph. In any case, contaminants are detrimental to the production of a high quality product, and in some situations a health risk to employees of the producer and possibly even a source of danger in that some contaminants can produce a dust cloud which, if exposed to an ignition source, may explode.

Considering product quality, and focusing on moldable plastics as a primary example, foreign material different in composition from the primary material, such as dust, non-uniform material of the primary product, fluff, and streamers, does not necessarily have the same melting temperatures as the primary product and causes flaws when the material is melted and molded. These flaws result in finished products that are not uniform in color, may contain bubbles, and often appear to be blemished or stained, and, therefore, cannot be sold. Heat in the injection molding machine can vaporize dust that leads to tiny gas bubbles in the finished product. Heat also burns dust and causes "black spots", actually carbonized dust. Sometimes dust pockets in the machine don't melt and cause "soft spots" or "white spots" as these defects are commonly called. It is important to note that, since these same non-uniform materials often do not melt at the same temperature as the primary product, the un-melted contaminants cause friction and premature wear to the molding machines, resulting in downtime, lost production, reduced productivity, increased maintenance and, thus, increased overall production costs.

Conventional particulate material dedusting devices, such as is disclosed in U.S. Pat. No. 5,035,331, granted to Jerome I. Paulson on Jul. 30, 1991, utilize first and second wash decks, formed as sloped planar surfaces within the apparatus and having openings therein for the passage of pressurized air therethrough to pass through particulate material flowing along the wash decks. Between the two wash decks, the particulate material passes through a Venturi zone, which combined with the passage of air through the particulate material on the wash decks, discharges dust and other contaminates upwardly with the air flow to be discharged from the apparatus.

In U.S. Pat. No. 7,380,670, granted on Jun. 3, 2008, to Jerome I. Paulson, Heinz Schneider and Paul Wagner, a compact dedusting apparatus having back-to-back wash deck assemblies, provides increased capacity by doubling the wash decks and the Venturi zones, which requires the inflow of particulate material to be equally divided between the two wash deck assemblies. In both U.S. Pat. No. 5,035,331 and U.S. Pat. No. 7,380,670, a magnetic flux field is applied to the infeed of particulate material to neutralize the static charges attracting the contaminates to the particulate pellets to enhance the operation of the wash decks in separating contaminates from the particulate material.

Accordingly, it would be desirable to provide a dedusting apparatus that would be operable to clean contaminates from greater quantities of particulate material without increasing the overall size of the dedusting apparatus, while providing wash deck and Venturi zone operations similar to that of conventional planar wash deck dedusting apparatus.

SUMMARY OF THE INVENTION

It is an object of this invention to provide a dedusting apparatus for use with particulate material, such as plastic pellets, that provides 360 degrees of operation to remove dust and debris from the particulate material.

It is another object of this invention to provide a conical wash deck that will receive a flow of particulate material over the surface thereof to provide 360 degrees of dedusting operation for particulate material.

It is a feature of this invention to provide a material infeed apparatus that provides a flow of particulate material over a conical wash deck apparatus.

It is an advantage of this invention that the flow rate of particulate material through a dedusting apparatus can be increased without substantially increasing the size of the dedusting apparatus.

It is another advantage of this invention that the flow rate of particulate material over the conical wash deck can be adjusted by manipulating the distance between the material infeed apparatus and the conical wash deck.

It is another feature of this invention that the flow rate of particulate material over the surface of the conical wash deck can be adjusted by vertically moving the material infeed apparatus relative to the conical wash deck.

It is another feature of this invention that the tip of the conical wash deck can serve as a stopper when inserted into the frusto-conical material infeed apparatus to vary the flow rate of particulate material over the surface of the conical wash deck.

It is another object of this invention to provide a cylindrical dedusting apparatus having an air infeed duct directing the flow of air into the underside of the conical wash deck to be directed outwardly through the wash deck surface through openings formed in the wash deck.

It is still another object of this invention to provide an air discharge conduit located above the wash deck apparatus to receive a flow of air passing through the wash deck and carrying dust and debris cleaned from the particulate material fed over the surface of the wash deck.

It is still another feature of this invention that the air discharge conduit includes a circular collector formed with an air flow restriction in a portion thereof opposite a discharge conduit.

It is still another advantage of this invention that the flow restriction in the circular collector urges the collected air toward the discharge conduit by decreasing the volume of the collection chamber opposite the discharge conduit.

It is yet another feature of this invention that the discharge conduit extends radially from the circular collector.

It is yet another advantage of this invention that the radially oriented discharge conduit operates to collect air entering the circular collector uniformly from either side of the circular collector.

It is still another advantage of this invention that the conical wash deck is positionally fixed on the air infeed conduit.

It is yet another object of this invention to provide an externally operable adjustment mechanism varying the flow rate of the particulate material fed onto the wash deck.

It is a further feature of this invention that the material infeed mechanism is connected to an adjustment mechanism mounted on the circular collector such that the vertical position of the infeed mechanism can be selected by rotation of threaded knobs accessible on the exterior of the circular collector, or by operation of remotely operable air or hydraulic cylinders.

It is still a further feature of this invention that the infeed mechanism includes a frusto-conical material infeed hopper includes plastic bumpers that engage a cylindrical sleeve to keep the infeed hopper moving vertically when positionally adjusted through the threaded adjustment mechanism.

It is a further advantage of this invention that the frusto-conical infeed hopper will be centered over the tip of the conical wash deck irrespective of the vertical position selected for the infeed hopper to establish the flow rate of particulate material over the wash deck.

It is yet another object of this invention to provide a transparent housing for a portion of the dedusting apparatus to permit a viewing of the operation of the internal components removing dust and contaminates from the particulate material.

It is another feature of this invention that the housing for the cylindrical dedusting apparatus can include a transparent cylindrical portion corresponding to the conical wash deck to permit an observation of the cleaning operation of the dedusting apparatus as particulate material moves over the conical wash deck.

It is still a further advantage of this invention that the observation of the wash deck operation will permit a determination of the effectiveness of the cleaning operation and a corresponding adjustment of product flow rate or air inflow rate to maximize the efficiency of the cleaning operation.

It is yet a further advantage of this invention that the transparent central portion of the outer housing will permit an observation of the turbulence within the Venturi zone and a determination of the need for adjustment of the flow rates.

It is a further object of this invention to provide a cylindrical dedusting apparatus providing 360 degrees of cleaning operation for particulate material, which is durable in construction, inexpensive of manufacture, carefree of maintenance, facile in assemblage, and simple and effective in use.

These and other objects, features and advantages are accomplished according to the instant invention by providing a cylindrical dedusting apparatus having an upper material infeed opening to introduce material into a frusto-conical infeed hopper centered over the tip of a conical wash deck supported over an air infeed conduit. The air is blown through slots and openings in the surface of the wash deck to separate dust and debris from the particulate material. The dust-laden air is discharged by passing between the infeed hopper and a cylindrical sleeve to enter into a circular collector for discharge from the apparatus. Flow rate of material over the wash deck is adjusted by vertically moving the infeed hopper within the sleeve relative to the wash deck, the tip serving as a stopper to define the dimension of the gap through which material flows onto the wash deck. Cleaned material passes through a lower discharge opening while dirty air is removed through a radially oriented discharge conduit from the circular collector.

BRIEF DESCRIPTION OF THE DRAWINGS

The advantages of this invention will become apparent upon consideration of the following detailed disclosure of the invention, especially when taken in conjunction with the accompanying drawings wherein:

FIG. 10 is a perspective view of the circular collector and the sleeve with the infeed hopper and the top plate of the circular collector removed for purposes of clarity;

FIG. 11 is a perspective horizontal cross-sectional view of the circular collector taken below the top plate to show the interior of the circular collector;

FIG. 12 is an elevational view of the conical wash deck;

FIG. 13 is a bottom plan view of the wash deck shown in FIG. 12;

FIG. 14 is a partial vertical cross-sectional view of the circular collector to show the relationship of the wash deck, infeed hopper, circular collector and sleeve when the infeed hopper is located at the maximum flow rate position as depicted in FIG. 2; and FIG. 15 is a partial vertical cross-sectional view similar to that of FIG. 14 but depicted the positioning of the infeed hopper at the minimum flow rate position as shown in FIG. 3.

DETAILED DESCRIPTION OF THE PREFERRED EMBODIMENT

Figure 1:
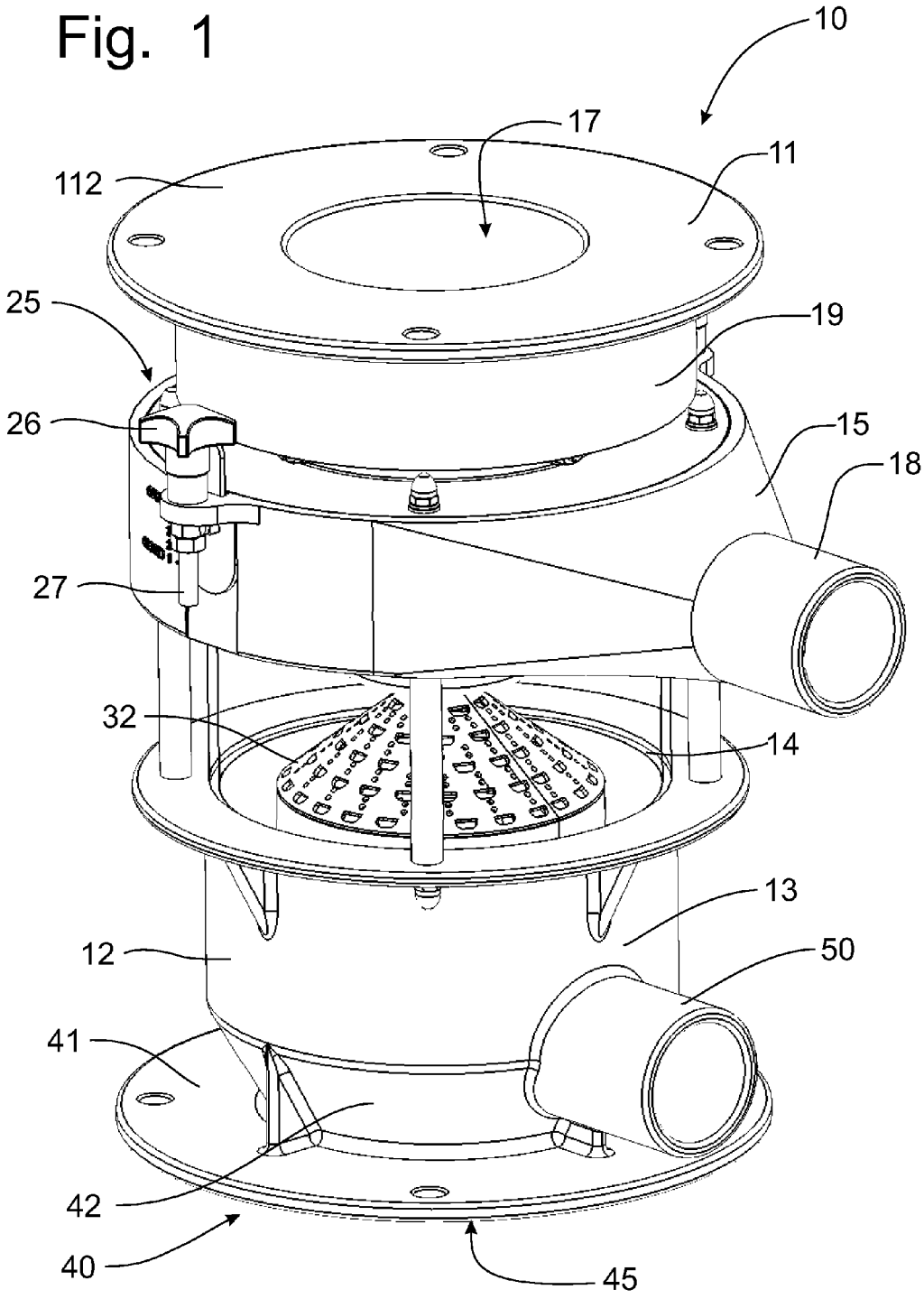
FIG. 1 is a perspective view of a cylindrical dedusting apparatus incorporating the principles of the instant invention.
Figure 2:
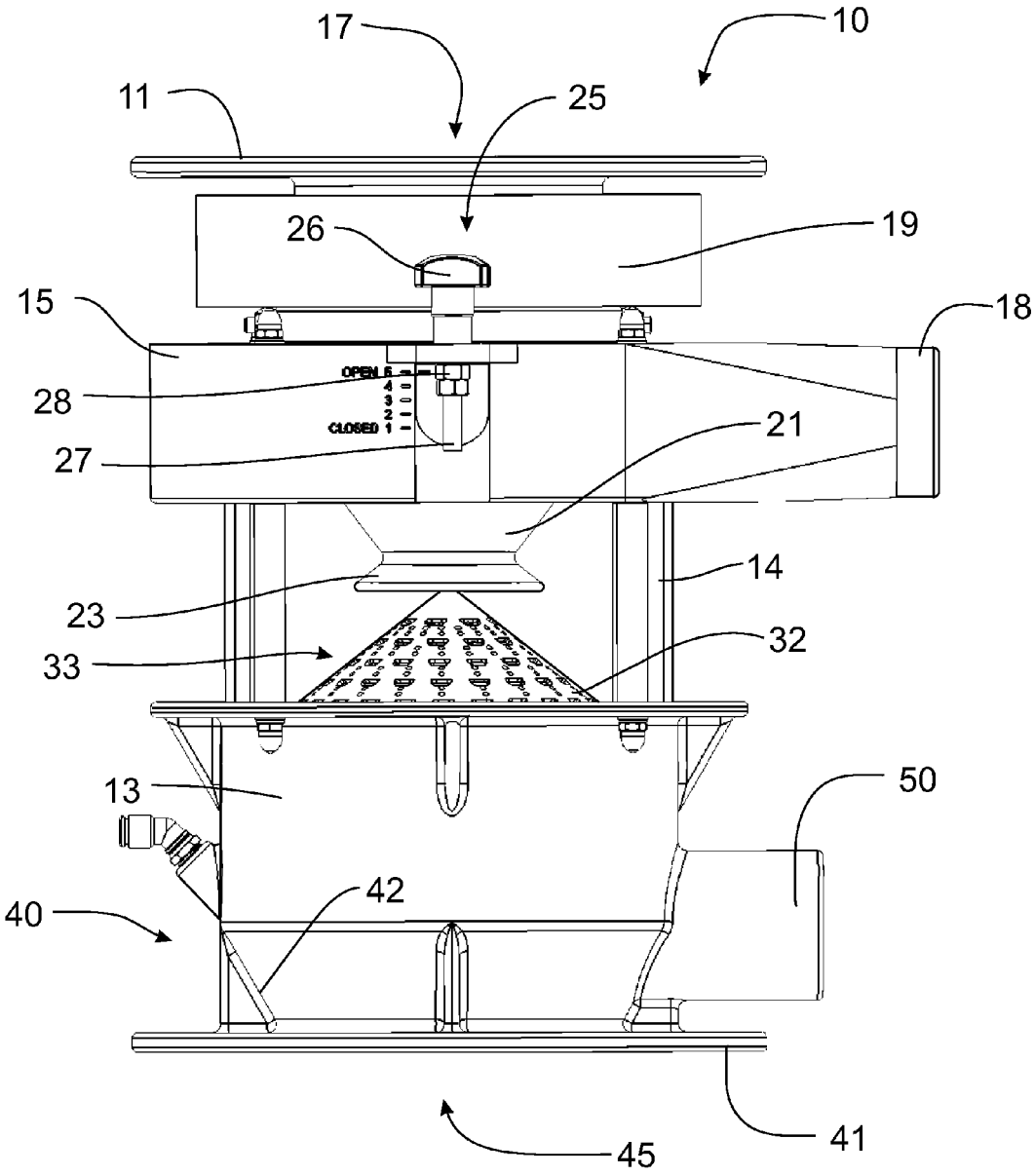
FIG. 2 is right side elevational view of the cylindrical dedusting apparatus shown in FIG. 1, the infeed hopper being positioned at a maximum height relative to the wash deck to provide a maximum flow rate of particulate material onto the conical wash deck.
Figure 3:
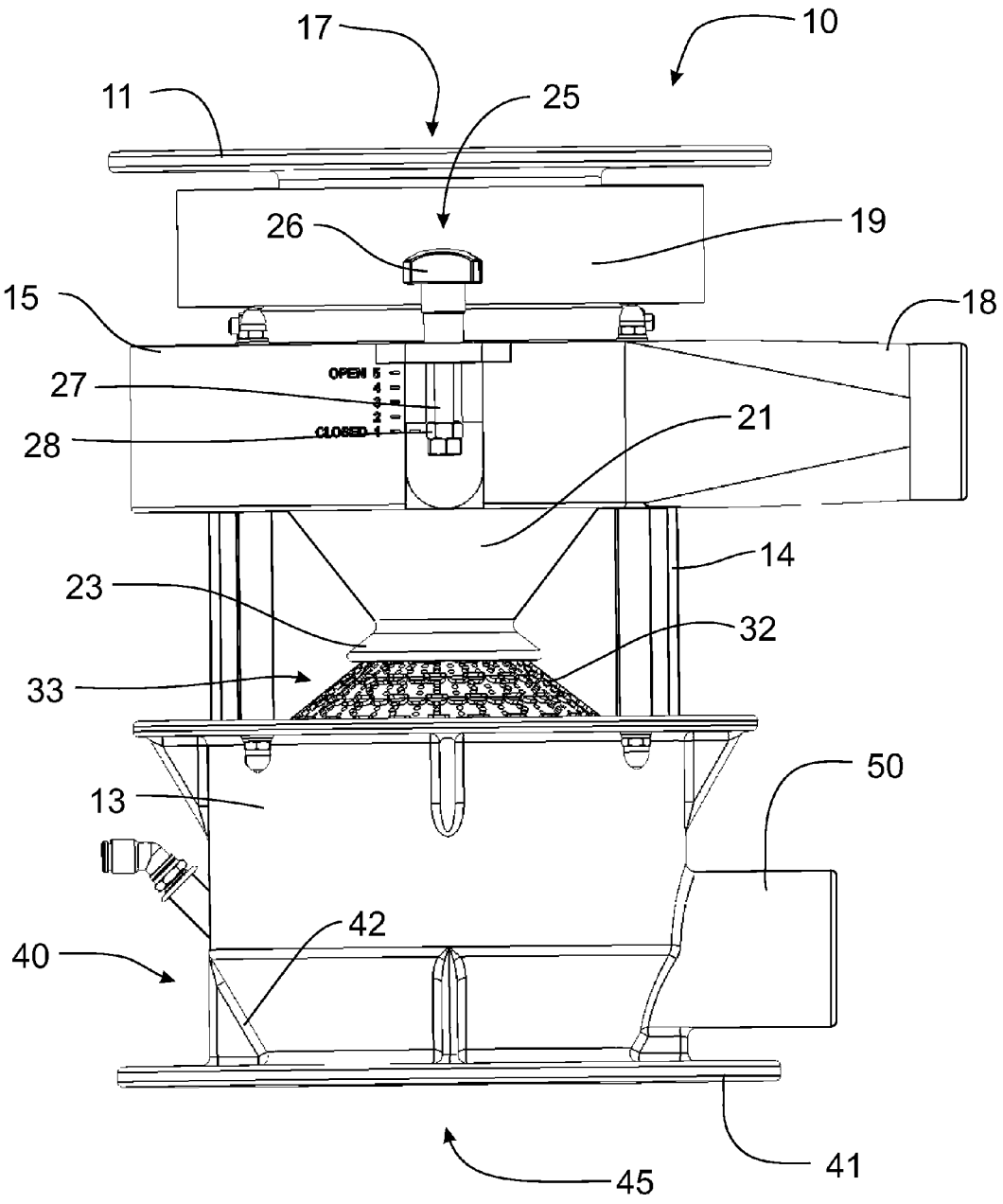
FIG. 3 is a right side elevational view of the cylindrical dedusting apparatus similar to that of FIG. 2, but with the infeed hopper lowered relative to the conical wash deck to minimize the gap therebetween and reduce the flow rate of particulate material over the wash deck.
Figure 5:
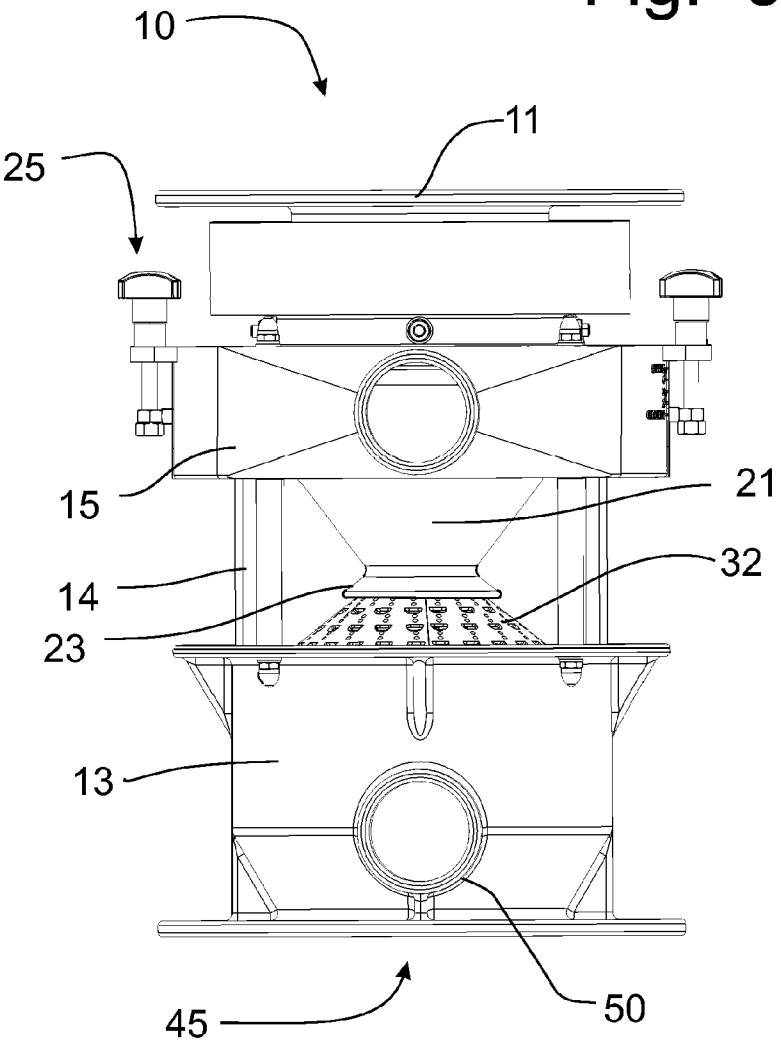
FIG. 5 is a front elevational view of the cylindrical dedusting apparatus similar to that of FIG. 4, but having the infeed hopper lowered to a minimum flow rate position as depicted in FIG. 3.
Figure 4:
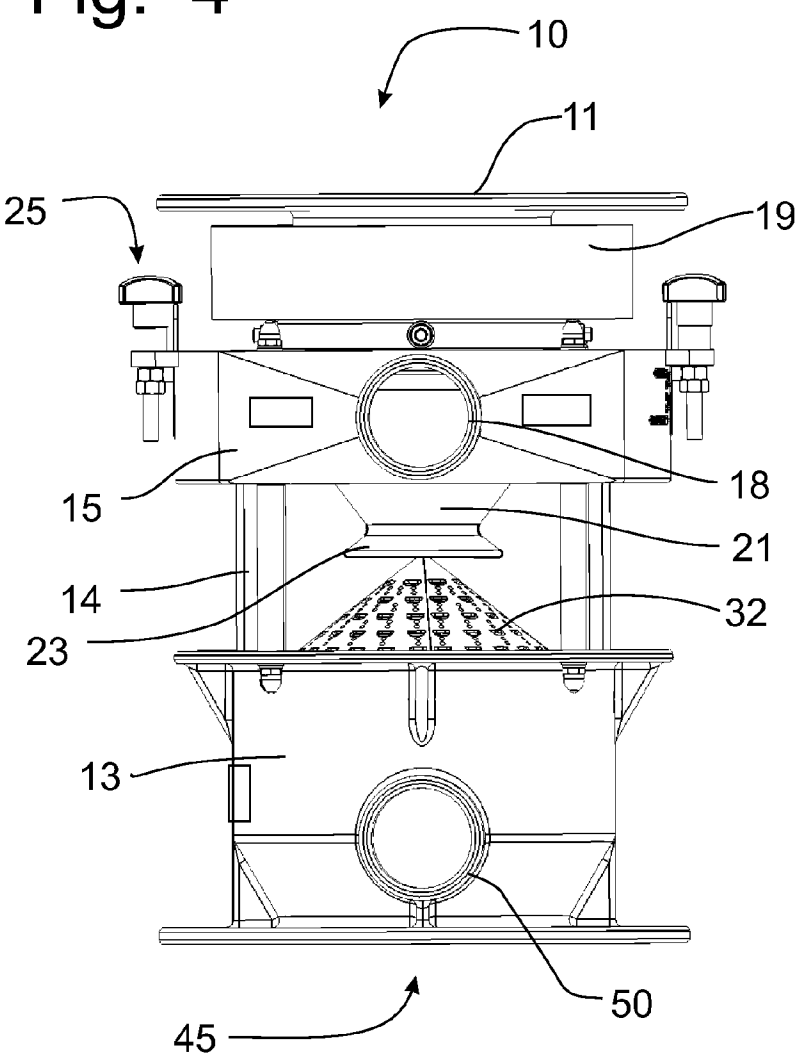
FIG. 4 is a front elevational view of the cylindrical dedusting apparatus looking into the air infeed and air discharge conduits, the infeed hopper being positioned at the maximum flow position as depicted in FIG. 2.

Referring to FIGS. 1-9, a cylindrical dedusting apparatus incorporating the principles of the instant invention can best be seen. The cylindrical dedusting apparatus utilizes the known dedusting techniques disclosed in U.S. Pat. No. 5,035,331, issued to Jerome I. Paulson on Jun. 3, 1991, including the passage of pressurized air through a sloped, slotted wash deck, and the passage of air through a Venturi zone where particulate material passes. However, these known contaminate removing techniques are structured in a different configuration heretofore unknown in the art.

The dedusting apparatus 10 is generally cylindrical in shape and configuration. The outer housing 12 is formed of cylindrical components with the dedusting apparatus 20 centrally positioned internally thereof. The housing 12 preferably includes a lower cylindrical housing member 13, a central cylindrical housing member 14 and an upper circular collector member 15 mounted on the central housing member 14 and connected to the lower housing member 13 by fasteners 121 that trap the central housing member 14 between the circular collector 15 and the lower housing member 13. A material infeed opening 111 is defined by a flanged infeed sleeve 11 that extends downwardly through the circular collector 15 to engage the infeed hopper 21, as will be described in greater detail below.

The outer cylindrical housing 12 is preferred to be in a three-part configuration to facilitate disassembly for purposes of cleaning and maintenance; however, one skilled in the art will recognize that a single-piece unitary housing could also be utilized. Although the central housing member 14 is depicted as being semi-transparent, the lower housing member 13 is preferably formed of a rigid metallic material, such as stainless steel, to provide an enhanced ability to support the air inflow conduit 50 as will be described in greater detail below. The central housing member 14 is preferably constructed of a semi-transparent or transparent polycarbonate to permit a viewing of the operation of the wash deck assembly 30. Observation of the cleaning operation at the wash deck apparatus 30 is an effective way to determine if the product flow rate and the air inflow rate need to be adjusted. Looking at the turbulence within the Venturi zone 49 provides a good indication. If too much turbulence exists, cleaned particulate material is not falling to the product discharge opening 45 and product can be carried over to the air discharge and lost from the system. In this situation, the air flow rate needs to be reduced. If insufficient turbulence exists, the product flow rate can be reduced or the air flow rate can be increased.

The circular collector 15 is mounted on top of the central housing member 14 so as to be sealed against the central housing member 14. As best seen in FIGS. 10 and 11, the circular collector 15 is formed with an annular chamber 16 having a central opening 17 therethrough where the material feed hopper 21 is mounted for the passage of particulate material to be cleaned. The circular collector 15 incorporates a radially aligned discharge pipe 18 through which the dirty, contaminate-laden air is discharged from the dedusting apparatus 10. As is described in greater detail below, dust-laden air passes around the material infeed hopper 21 and travels over the low interior wall 161 into the annular chamber 16 defined between the interior wall 161 and the higher outer wall 162.

The distal portion of the annular chamber 16 most remote from the discharge conduit 18 is formed with a sloped baffle 163 that restricts the volume of the distal portion of the annular chamber 16 so that the air velocity will be increased to carry the dust and contaminates around the annular chamber 16 to the discharge conduit 18. Preferably, negative pressure is applied to the discharge pipe 18 to enhance the flow of air from the dedusting apparatus 10. With the discharge pipe 18 exiting the air discharge ring 15 radially, the flow of air being discharged from the housing 12 will become cyclonic with increasing velocities that will further reduce pressures in the air discharge ring 15 and draw the dusty air from the housing 12 into the air discharge ring 15.

The top of the cylindrical dedusting apparatus 10 will have a mounting flange 112 for connecting to a supply hopper (not shown) in a conventional manner to provide a supply of particulate material into the cylindrical dedusting apparatus 10. Preferably, the top mounting flange 112 is spaced above the circular collector 15 to provide a mounting location for a magnetic coil 19 that generates a magnetic flux field operable to neutralize static charges between the particulate material and the contaminate particles and enhance the cleaning operation of the wash deck assemblies 30, as will be described in greater detail below.

The circular collector 15 supports a frusto-conical feed hopper 21 shaped with sloping sides somewhat like a funnel to direct the particulate material provided by the supply hopper (not shown) to a discharge opening 22 at the bottom of the frusto-conical feed hopper 21. The lowermost portion of the feed hopper 21, extending below the discharge opening 22, is formed with a reverse conical deflector member 23 that extends circumferentially around the discharge opening for purposes described in greater detail below. The sleeve 113 is received within the material infeed hopper 21 to direct particulate material into the hopper 21.

As best seen in FIGS. 8, 9, 14 and 15, the material infeed hopper 21 is preferably formed with opposing, radially extending mounting arms 24 that interconnect with corresponding adjustment mechanism 25 supported on the circular collector 15. Thus, the material infeed hopper 21 is suspended from the circular collector 15 for vertical movement relative thereto. The adjustment mechanism 25 can be a mechanical device that is manually operated and, thus, can include knobs 26 with vertically extending threaded rods 27 engaged with threaded nuts 28 on the distal ends of the mounting arms 24. Rotation of the knobs 26 in this adjustment mechanism 25 causes the mounting arms 24 and the infeed hopper 21 connected thereto to move vertically relative to the sleeve 113 and relative to the circular collector 15. For larger dedusting apparatus 10, the manually operated adjustment mechanism 25 can be replaced with a remotely operable air or hydraulic cylinder (not shown). Preferably, the material infeed hopper 21 will also include plastic bumpers 29 affixed to the exterior surface thereof to engage the interior vertical side of the low interior wall 161 and keep the hopper 21 centered with respect to the conical wash deck assembly 30.

The vertical movement of the material infeed hopper 21 varies the position of the reverse conical deflector 23 and the discharge opening 22 relative to the tip 31 of the conical wash deck assembly 30. As the reverse cone deflector 23 moves downwardly over the wash deck assembly 30, the tip 31 extends into the discharge opening 22 and restricts the flow of material through the discharge opening 22 by reducing the size of the gap 39 between the deflector 23 and the wash deck assembly 30. Thus, the lower the material infeed hopper 21 is positioned relative to the wash deck assembly 30, the lower the flow rate of particulate material through the discharge opening 22 will be. The size of the gap 39 depends on the desired flow rate and the relative size of the particulate pellets being passed over the wash deck 32. The tip 31 of the wash deck 32 is positioned centrally within the discharge opening 22 so that the tip 31 deflects a uniform flow of particulate material circumferentially over the wash deck 32. The deflector member 23 also serves to direct the flow of particulate material in a laminar manner over the wash deck 32 without allowing the particulate pellets to bounce off the wash deck 32 after dropping out of the feed hopper 21. Preferably, the exterior side of the circular collector 15 will be formed with markings to provide an indication of the flow rate.

An air inflow conduit 50 is supported on the lower housing member 13, passing radially through the lower housing member 13 to provide a supply of pressurized air into the cylindrical dedusting apparatus 10. Although not specifically shown in the drawings, one skilled in the art will recognize that the air inflow conduit 50 can be supported on struts and braces as necessary to mount the air flow conduit 50 in a fixed stationary position relative to the lower housing member 13. One skilled in the art will recognize that the specific diameter of the air inflow conduit 50 will be determined by the air flow rates and air pressures required for a specific application.

Figure 7:
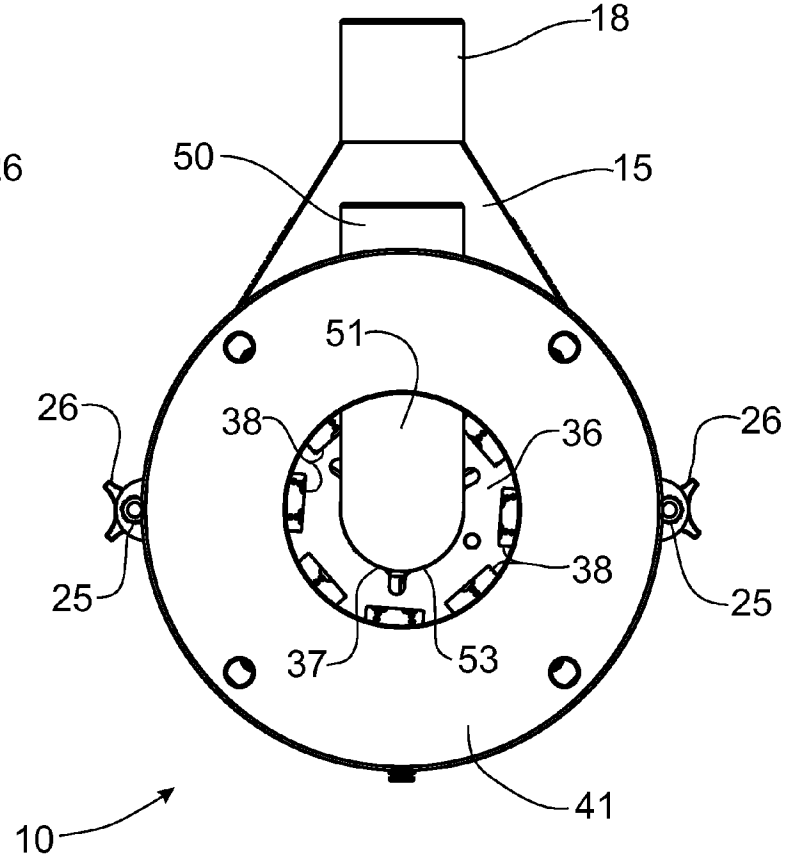
FIG. 7 is a bottom plan view of the cylindrical dedusting apparatus looking into the material discharge opening.
Figure 6:
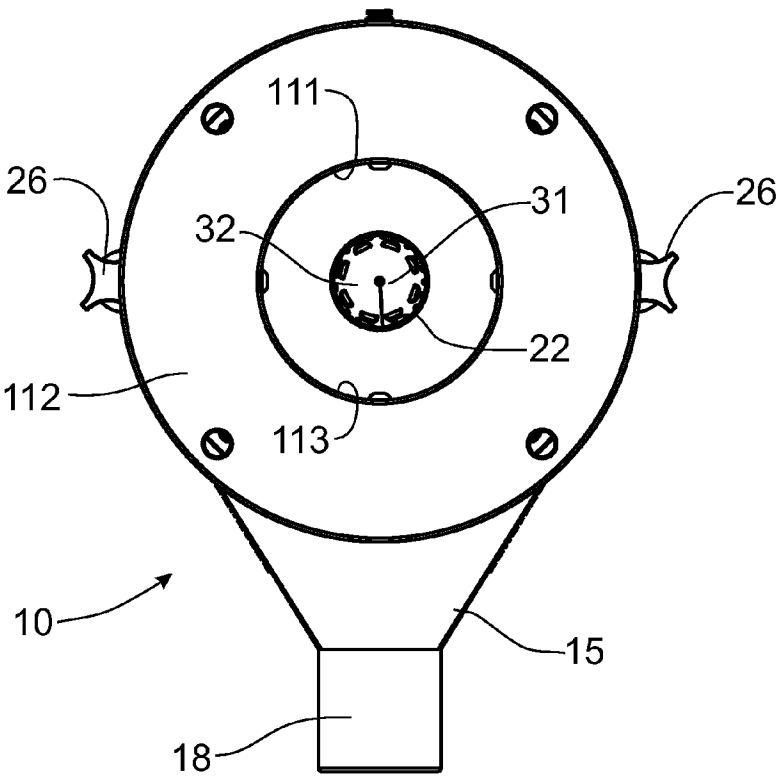
FIG. 6 is a top plan view of the cylindrical dedusting apparatus looking into the material infeed opening.
Figure 8:
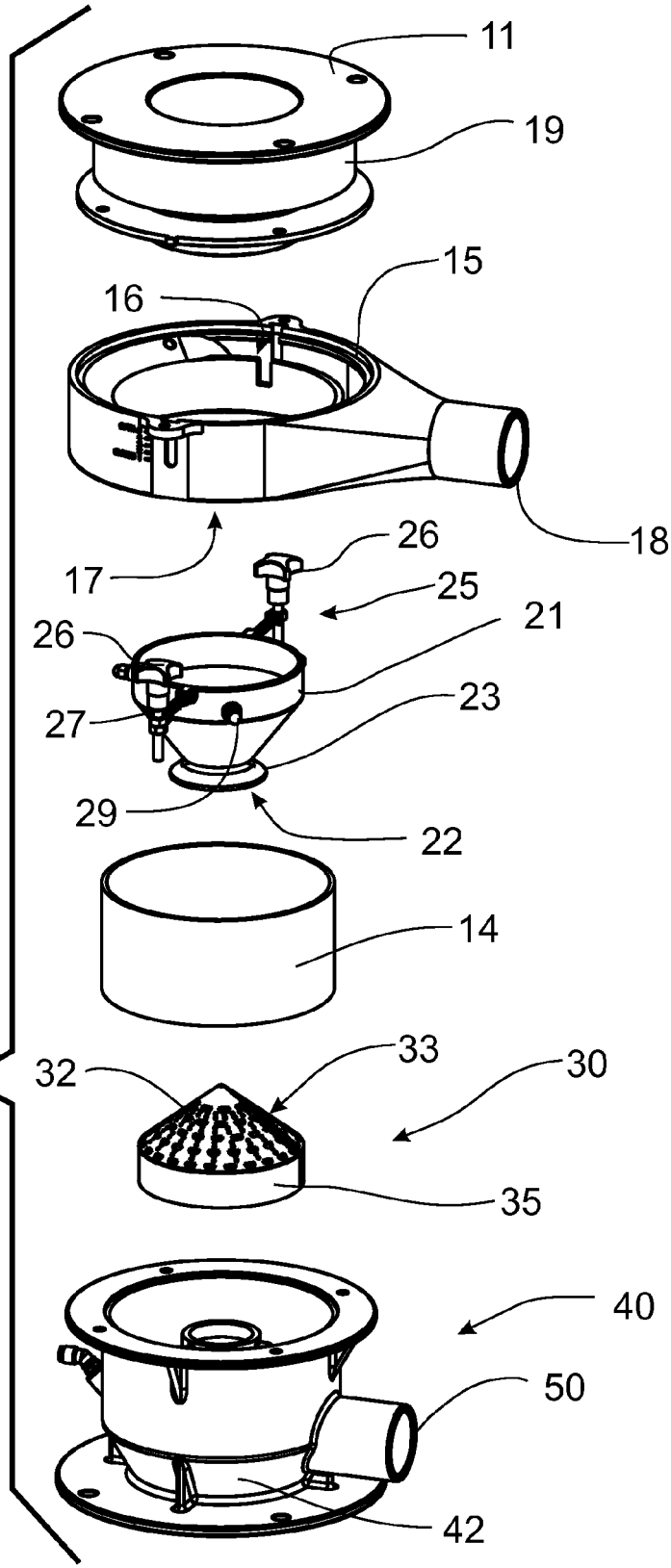
FIG. 8 is an exploded view showing the component parts of the cylindrical dedusting apparatus.

The air inflow conduit 50 is formed with a generally horizontally extending leg 51 that passes through the lower housing member 13 and terminates in an upwardly vertically extending leg 53 that is located at the center of the cylindrical dedusting apparatus 10. The terminus (not shown) of the vertically extending leg 53 passes through the bottom plate 36 of the wash deck assembly 30, as is best seen in FIG. 7, to direct a flow of air into the interior of the conical wash deck assembly 30. The wash deck assembly 30 is preferably mounted on the vertically extending leg 53 so as to be positionally fixed on the air inflow conduit 50 so that the vertically movable material infeed hopper 21 can be positioned to define the flow rate of particulate material over the wash deck assembly 30.

The wash deck assembly 30 is formed as an inverted cone affixed to or formed with a cylindrical mounting portion 35 that has a bottom plate member 36 formed with a mounting opening 37 located centrally in the bottom plate 36 to mate with and engage the terminus of the air inflow conduit 50 so that the wash deck assembly 30 can be detachably mounted onto the air inflow conduit 50. The sloping wash deck 32 is formed with a plurality of apertures 33, formed as slots and circular openings, extending around the entire peripheral surface of the wash deck 32 to direct air flow through the particulate material passing over the conical wash deck 32, as will be described in greater detail below.

The bottom member 36 of the cylindrical mounting portion 35 can be formed with a plurality of circumferentially spaced vents 38 around the perimeter of the bottom member 36, as can be seen best in FIG. 13. These vents 38 allow an escape of air from the wash deck assembly 30 to flow downwardly out of the cylindrical mounting member 35 and then upwardly toward the circular collector 15 between the outer circumference of the cylindrical mounting member 35 and the central housing member 14 to create a Venturi zone 49 for the further cleaning of the particulate material discharged off the wash deck 32, as will be described in greater detail below. In open material handling systems where the dedusting apparatus 10 is used to clean the material, a sufficient flow of air may naturally flow upwardly through the Venturi zone 49 so that the bottom plate 36 does not need to be formed with the vents 38 and all of the air fed into the wash deck assembly 30 through the air inflow conduit 50 will pass through the apertures 33 to clean the particulate material.

The apertures 33 in the wash deck 32 are formed to direct air flow uniformly through the wash deck 32 to remove contaminate particles from the particulate material passing over the wash deck 32. The drawings reflect discrete lines of apertures 33 on the wash deck 32, but one skilled in the art will recognize that other aperture distribution patterns may provide a more efficient distribution of air flow through the wash deck 32. Thus, the depiction of the apertures 33 on the wash deck 32 in the drawings is intended to be schematic and representative of an apertured wash deck 32, rather than a determinative pattern.

Figure 9:
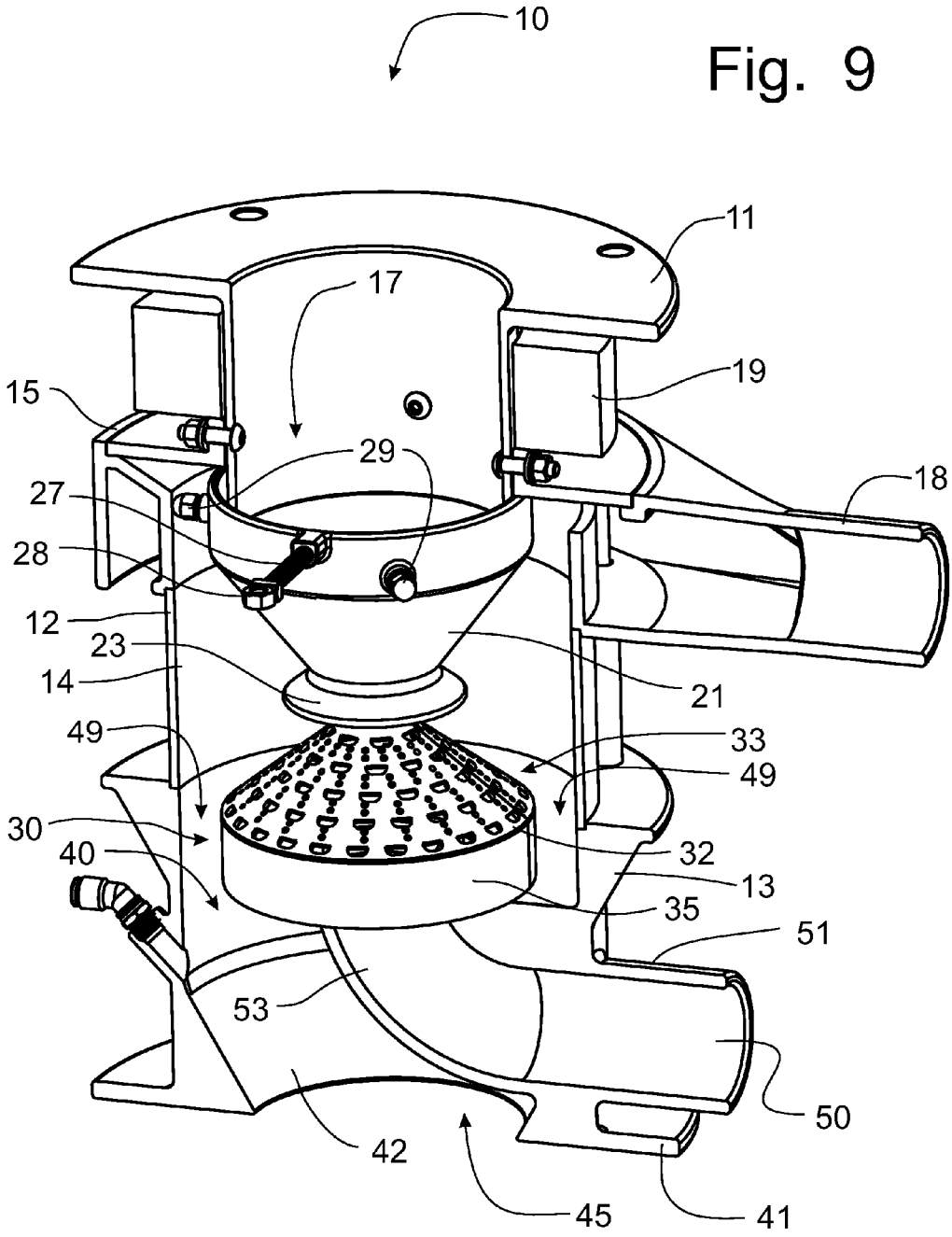
FIG. 9 is a perspective cross-sectional view of the cylindrical dedusting apparatus corresponding to lines 9-9 of FIG. 6, the wash deck and infeed hopper being retained without sectioning to show the relationship between the wash deck, the infeed hopper, the housing and the circular collector for discharging dirty air from the apparatus.

As best seen in FIG. 9, the lower housing member 13 is formed as a product discharge assembly 40, including a lower mounting flange 41 to permit connection of the cylindrical dedusting apparatus 10 to a device (not shown) that utilizes the cleaned particulate pellets being discharged from the dedusting apparatus 10. The product discharge assembly 40 also includes a frusto-conical guide pan 42 that extends from the lower housing member 13 to the central product discharge opening 45. Cleaned particulate material passing through the Venturi zone 49 between the outer periphery of the cylindrical mounting portion 35 and the upper housing member 14 will fall onto the guide member 42 which will move the cleaned particulate material into the discharge opening 45.

For purposes of cleaning and maintenance of the cylindrical dedusting apparatus 10, the circular collector 15, along with the mounted feed hopper 21 and deflector member 23, can be disconnected from the central housing member 14 and removed with the flanged material inlet sleeve 11 from the housing 12 by detaching the fasteners 121. The flanged inlet sleeve 11 and the magnetic coil 19 will typically be removed from the circular collector 15 for cleaning and servicing.

After removal of the circular collector 15 and the associated feed hopper 21, the wash deck assembly 30 can be accessed and dismounted from the terminus of the air inflow conduit 50. In addition, the central housing member 14 can be detached from the lower housing member 13 to enhance the access to the wash deck assembly 30, leaving the lower housing member 13 and the mounted air inflow conduit 50 with the product discharge assembly 40 to be cleaned independently. With the cylindrical dedusting apparatus 10 broken down into its modular components, the cleaning of the dedusting apparatus 10 is easily accomplished after which the components can be re-assembled and placed into operational form.

In operation, the flow of particulate product moves through the dedusting apparatus 10 from the inlet opening 111 to the discharge opening 45. Pressurized air is moved through the air inflow conduit 50 and discharged into the wash deck assembly 30. The pressurized air escapes from the wash deck assembly 30 through the vents 38 on the bottom member 36 of the cylindrical mounting portion 35, and through the apertures 33 on the sloped wash deck 32. The escaped air flows to the circular collector 15 at the top of the central housing member 14 for removal from the cylindrical dedusting apparatus 10 through the air discharge conduit 18.

While air is moving through the cylindrical dedusting apparatus 10, as described above, the particulate material is moving by gravity downwardly through the feed hopper 21 which concentrates through the conical shape of the feed hopper 21 the flow of particulate material moving through the discharge opening 22. The tip 31 of the wash deck 32 projecting into the discharge opening 22 at the center of the discharge opening 22 equally divides the particulate material around the tip 31 for continued downward movement over the sloped wash deck 32. The rate of flow of the particulate material is controlled by the positional adjustment of the infeed hopper 21 relative to the wash deck assembly 30 to vary the width of the gap 39 between the upper portion of the wash deck 32 and the deflector member 23.

The air flowing outwardly through the apertures 33 in the wash deck 32 provide the first cleaning action to the particulate material to separate contaminate material therefrom as the particulate material passes over the sloped wash deck 32. With the apertures 33 extending along the length of the wash deck 32, the particulate material is subjected to cleaning action along the entire path of the particulate material over the wash deck 32. Ultimately, the particulate material falls off of the sloped wash deck 32 and passes along the cylindrical mounting portion 35. The flow of air escaping through the vents 38 around the outer circumference of the bottom plate member 36 passes through the particulate material falling past the cylindrical mounting portion 35 through the Venturi zone 49 to subject the particulate material to a second cleaning action.

The size of the Venturi zone 49 enables the air escaping through the vents to increase velocity as the air passes through the Venturi zone 49. The velocity of the air has to be high enough to subject the particulate material to an aggressive cleaning action, but not so high as to carry the particulate material upwardly and prevent the movement of the particulate material to the product discharge assembly 40. The size of the Venturi zone 49 is product specific and can be adjusted by the size of the wash deck assembly 30, or by varying the size of the outer housing 12. Accordingly, if the size of the Venturi zone 49 needs to be reduced, a larger wash deck assembly 30 can be mounted on the vertically extending leg 53 of the air inflow conduit 50. Furthermore, the vertical positioning of the deflector member 23 relative to the wash deck assembly 30 is typically product specific and can be secured in the desired location.

After passing through the Venturi zone 49, the particulate material drops onto the guide member 42 and is moved into the product discharge opening 45 for discharge from the cylindrical dedusting apparatus 10. The dust-laden air, having separated dust and other contaminate materials from the flow of particulate material passing over the wash deck 32 and through the Venturi zone 49, carries the dust and contaminates upwardly to the circular collector 15 where the dust-laden air is removed from the cylindrical dedusting apparatus 10 through the air discharge conduit 18.

Operational capacity, in terms of the amount of particulate material being cleaned by the cylindrical dedusting apparatus 10 over a given period of time, is increased, as compared to the conventional flat plate dedusting apparatus, represented in U.S. Pat. No. 5,035,331 and in U.S. Pat. No. 7,380,670, due to the 360 degree cleaning operation of the cylindrical dedusting apparatus 10. Thus, the cylindrical dedusting apparatus 10 provides a greater wash deck area for a given overall size of the housing 12 than can be obtained in the conventional flat plate dedusting apparatus. The Venturi zone 49 extends circumferentially around the wash deck assembly 30, instead of simply at the end of the wash deck on the conventional flat plate dedusting apparatus.

It will be understood that changes in the details, materials, steps and arrangements of parts, which have been described and illustrated to explain the nature of the invention will occur to and may be made by those skilled in the art upon a reading of this disclosure within the principles of the scope of the invention. The foregoing description illustrates the preferred embodiment of the invention; however, concepts, as based upon the description may be employed in other embodiments without departing from the scope of the invention. Accordingly, the following claims are intended to protect the invention broadly, as well as in the specific form shown.

Having thus described the invention, what is claimed is:

1. A dedusting apparatus for cleaning contaminates from particulate material, said dedusting apparatus being formed in modules comprising:

a cylindrical housing defining an upper product inlet opening and a lower product discharge opening;

a feed hopper terminating in a lower feed hopper discharge opening;

an air supply apparatus supported by said housing at a lower portion thereof and terminating in a vertically oriented leg located centrally within said housing;

an inverted conical wash deck assembly mounted on said vertically oriented leg and being oriented with an apex thereof positioned centrally within said feed hopper discharge opening, said wash deck being formed with a plurality of apertures around the conical surface thereof for the passage of air through said wash deck and with a bottom plate member having a central opening therein for the passage of said air supply apparatus, said bottom plate member including vents arranged around a circumferential edge thereof to allow air to move through said vents and upwardly between said wash deck assembly and said housing to create a Venturi zone around said wash deck assembly to clean particulate material falling off of said wash deck assembly; and an air discharge collector detachably mounted on top of said housing.

2. The dedusting apparatus of claim 1 wherein said feed hopper is supported from said air discharge collector for vertical movement relative to said wash deck assembly.

3. The dedusting apparatus of claim 2 wherein said feed hopper is supported on an adjustment mechanism selectively operable to affect vertical movement of said feed hopper.

4. The dedusting apparatus of claim 3 wherein said upper product inlet opening is defined by a flanged sleeve having a vertically oriented sleeve projecting into a central opening in said air discharge collector.

5. The dedusting apparatus of claim 4 wherein said feed hopper is positioned within said central opening in said air discharge collector, said feed hopper having spacers affixed to the exterior thereof to center said feed hopper within said central opening when vertically moved by said adjustment mechanism.

6. The dedusting apparatus of claim 1 wherein said air discharge collector includes an annular chamber surrounding a central opening in said air discharge collector, said annular chamber being defined by an interior wall defining said central opening and an exterior wall, said exterior wall projecting higher than said interior wall so that air from said wash decks and said Venturi zones can pass between said feed hopper and said interior wall and pass over said interior wall into said annular chamber for discharge from the dedusting apparatus.

7. The dedusting apparatus of claim 6 wherein said air discharge collector is formed with a radially extending air discharge conduit in flow communication with said annular chamber.

8. The dedusting apparatus of claim 7 wherein said annular chamber includes a baffle in a distal portion thereof opposite said air discharge conduit to restrict the cross-sectional area of said annular chamber to increase the velocity of said air within said distal portion.

9. The dedusting apparatus of claim 1 wherein said wash deck assembly includes an inverted conical wash deck terminating with said apex being positioned within said hopper discharge opening to control the flow of material from said feed hopper.

10. The dedusting apparatus of claim 9 wherein said wash deck assembly is mounted on said air supply apparatus such that said air supply apparatus directs a flow of air internally of said wash deck apparatus for passage through said apertures.

11. The dedusting apparatus of claim 10 wherein said cylindrical housing includes a transparent central housing member corresponding to said wash deck assembly to permit observation of the operation of said wash deck assembly.

12. A dedusting apparatus for cleaning contaminates from particulate material, comprising:

a generally cylindrical housing defining a product inlet opening and a product discharge opening;

a frusto-conical feed hopper in flow communication with said product inlet opening and defining a feed hopper discharge opening through which contaminated particulate material passes;

a wash deck assembly including a conical wash deck terminating in a tip located at said feed hopper discharge opening to direct the flow of said contaminated particulate material uniformly over the conical wash deck, said wash deck assembly being spaced from said housing;

said conical wash deck being formed with a plurality of apertures for the passage of air through the wash deck to clean contaminates from said contaminated particulate material passing over said wash deck;

an air supply in flow communication with said wash deck assembly to deliver a supply of air into said wash deck assembly, said air escaping said wash deck assembly through said apertures to clean contaminates from said contaminated particulate material passing over said wash;

said wash deck assembly including a bottom plate member having a central opening therein for the passage of said air supply apparatus, said bottom plate member including vents arranged around a circumferential edge thereof to allow air to move through said vents and upwardly between said wash deck assembly and said housing to create a Venturi zone around said wash deck assembly to clean particulate material falling off of said wash deck assembly; and an air discharge collector to discharge contaminate-laden air from said housing, said air discharge collector having a central opening for the passage of said particulate material into said feed hopper.

13. The dedusting apparatus of claim 12 said feed hopper is supported from said air discharge collector by an adjustment mechanism for vertical movement relative to said wash deck assembly.

14. The dedusting apparatus of claim 13 wherein said feed hopper is positioned within said central opening in said air discharge collector, said feed hopper having spacers affixed to the exterior thereof to center said feed hopper within said central opening when vertically moved by said adjustment mechanism.

15. The dedusting apparatus of claim 14 wherein said air discharge collector includes an annular chamber surrounding said central opening, said annular chamber being defined by an interior wall defining said central opening and an exterior wall, said exterior wall projecting higher than said interior wall so that air from said wash decks and said Venturi zones can pass between said feed hopper and said interior wall and pass over said interior wall into said annular chamber for discharge from the dedusting apparatus.

16. The dedusting apparatus of claim 15 wherein said product inlet opening is defined by a flanged sleeve having a vertically oriented sleeve projecting into a central opening in said air discharge collector.

17. The dedusting apparatus of claim 15 wherein said air discharge collector is formed with a radially extending air discharge conduit in flow communication with said annular chamber.

18. The dedusting apparatus of claim 15 wherein said wash deck assembly is mounted on said air supply apparatus such that said air supply apparatus directs a flow of air internally of said wash deck apparatus for passage through said apertures.

19. The dedusting apparatus of claim 18 wherein said wash deck assembly further includes a bottom plate member having a central opening therein for the passage of said air supply apparatus, said bottom plate member including vents arranged around a circumferential edge thereof to allow air to move through said vents and upwardly between said wash deck assembly and said housing to create a Venturi zone.

20. A dedusting apparatus for cleaning contaminates from particulate material, comprising:

a cylindrical housing defining an upper product inlet opening and a lower product discharge opening;

a feed hopper terminating in a lower feed hopper discharge opening surrounded by a conical deflector;

an air supply apparatus supported by said housing at a lower portion thereof and terminating in a vertically oriented leg located centrally within said housing;

an inverted conical wash deck assembly oriented with an apex thereof positioned centrally within said feed hopper discharge opening, said wash deck being formed with a plurality of apertures around the conical surface thereof for the passage of air through said wash deck, said conical deflector being oriented generally parallel to said conical surface of said wash deck to provide a laminar flow of particulate material over said conical surface, said wash deck assembly is formed being formed with a bottom plate member having a central opening therein for the passage of said air supply apparatus, said bottom plate member including vents arranged around a circumferential edge thereof to allow air to move through said vents and upwardly between said wash deck assembly and said housing to create a Venturi zone around said wash deck assembly to clean particulate material falling off of said wash deck assembly; and an air discharge collector mounted on top of said housing.

21. The dedusting apparatus of claim 20 wherein said Venturi zone surrounding said wash deck assembly opens upwardly into an expanded volume that allows air velocity to reduce before entering said air discharge collector.

22. The dedusting apparatus of claim 20 wherein said apex is positioned within said hopper discharge opening so that said conical deflector overlaps an upper portion of said conical surface to control the flow of particular material from said feed hopper onto said wash deck assembly.

23. The dedusting apparatus of claim 22 wherein said air discharge collector includes an annular chamber surrounding a central opening in said air discharge collector, said annular chamber being defined by an interior wall defining said central opening and an exterior wall, said exterior wall projecting higher than said interior wall so that air can pass between said feed hopper and said interior wall can flow over said interior wall into said annular chamber.

24. The dedusting apparatus of claim 23 wherein said air discharge collector is formed with a radially extending air discharge conduit in flow communication with said annular chamber.

25. The dedusting apparatus of claim 24 wherein said annular chamber includes a baffle in a distal portion thereof opposite said air discharge conduit to restrict the cross-sectional area of said annular chamber to increase the velocity of said air within said distal portion.

26. The dedusting apparatus of claim 20 wherein said cylindrical housing includes a transparent central housing member corresponding to said wash deck assembly to permit observation internally of said housing.

* * * * *